US006284071B1

(12) United States Patent
Suzuki et al.

(10) Patent No.: US 6,284,071 B1
(45) Date of Patent: Sep. 4, 2001

(54) TITANIUM ALLOY HAVING GOOD HEAT RESISTANCE AND METHOD OF PRODUCING PARTS THEREFROM

(75) Inventors: Akihiro Suzuki, Nagoya; Toshiharu Noda, Tajimi; Michio Okabe, Chita, all of (JP)

(73) Assignee: Daido Steel Co., Ltd., Nagoya (JP)

( * ) Notice: Subject to any disclaimer, the term of this patent is extended or adjusted under 35 U.S.C. 154(b) by 0 days.

(21) Appl. No.: 09/261,388

(22) Filed: Mar. 3, 1999

Related U.S. Application Data

(62) Division of application No. 08/996,198, filed on Dec. 22, 1997, now Pat. No. 5,922,274.

(30) Foreign Application Priority Data

Dec. 27, 1996 (JP) ..... 8-349648

(51) Int. Cl.[7] ..... C22F 1/18
(52) U.S. Cl. ..... 148/671
(58) Field of Search ..... 148/669, 670, 148/671

(56) References Cited

U.S. PATENT DOCUMENTS

| | | | |
|---|---|---|---|
| 3,833,363 | 9/1974 | Bomberger, Jr. et al. . | |
| 4,309,226 | 1/1982 | Chen . | |
| 4,606,886 | 8/1986 | Neal | 420/419 |
| 4,737,341 | 4/1988 | Barber | 420/419 |
| 4,738,822 | 4/1988 | Bania | 420/419 |
| 4,770,726 | 9/1988 | Neal et al. | 148/407 |
| 4,878,966 | 11/1989 | Alheritiere et al. | 148/421 |
| 5,399,212 | 3/1995 | Chakrabarti et al. | 148/421 |

*Primary Examiner*—John Sheehan
(74) *Attorney, Agent, or Firm*—Varndell & Varndell, PLLC

(57) ABSTRACT

A titanium alloy having improved heat resistance in addition to the inherent properties of lightness and corrosion resistance. The alloy consists essentially of, by weight %, Al: 5.0–7.0%, Sn: 3.0–5.0%, Zr: 2.5–6.0%, Mo: 2.0–4.0%, Si: 0.05–0.80%, C: 0.001–0.200%, O: 0.05–0.20%, optionally further one or two of Nb and Ta: 0.3–2.0%, and the balance of Ti and inevitable impurities. A method of producing parts from this alloy comprises subjecting the titanium alloy of the above described alloy composition to heat treatment at a temperature of β-region, combination of rapid cooling and slow cooling or combination of water quenching and annealing, hot processing in α+β region, solution treatment and aging treatment.

8 Claims, No Drawings

TITANIUM ALLOY HAVING GOOD HEAT RESISTANCE AND METHOD OF PRODUCING PARTS THEREFROM

CROSS REFERENCE TO RELATED APPLICATIONS

This application is a divisional application of U.S. Ser. No. 08/996,198, filed Dec. 22, 1997, now U.S. Pat. No. 5,922,274.

BACKGROUND OF THE INVENTION

1. Field in the Industry

The present invention concerns a titanium alloy having good heat resistance and a method of treating it. The invention provides a titanium alloy which has good heat resistance and can be used as a material for machine parts or structural members, to which lightness, corrosion resistance and heat resistance are required, for example, airplane engine parts such as blades, disks and casing for compressors, and automobile engine parts such as valves.

2. State of the Art

To date as the material for structural members, to which lightness, corrosion resistance and heat resistance are required, titanium alloys has been used. Examples of such titanium alloy are: Ti-6Al-4V, Ti-6Al-2Sn-4Zr-2Mo and Ti-6Al-2Sn-4Zr-2Mo-0.1Si.

Durable high temperatures of these titanium alloys are, for example, about 300° C. for Ti-6Al-4V alloy and about 450° C. for Ti-6Al-2Sn-4Zr-2Mo-0.0Si, and there has been demand for improvement in the durable temperatures of this kind of titanium alloys.

SUMMARY OF THE INVENTION

The object of this invention is to provide a titanium alloy having improved heat resistant property in addition to the inherent properties of lightness and good corrosion resistance, and to provide a method of producing heat resistant parts from the titanium alloy.

The titanium alloy having good heat resistance according to the present invention consists essentially of, by weight %, Al: 5.0–7.0%, Sn: 3.0–5.0%, Zr: 2.5–6.0%, Mo: 2.0–4.0%, Si: 0.05–0.80%, C: 0.001–0.200%, O: 0.05–0.20%, and the balance of Ti and inevitable impurities.

The method of producing titanium alloy parts having good heat resistance according to the present invention comprises subjecting the titanium alloy of the above described alloy composition to heat treatment at a temperature of β-region, combination of rapid cooling and slow cooling or combination of water quenching and annealing, hot processing in α+β region, solution treatment and aging treatment.

DETAILED EXPLANATION OF PREFERRED EMBODIMENTS

The titanium alloy having good heat resistance according to the present invention may have an alternative alloy composition consisting essentially of, by weight %, Al: 5.0–7.0%, Sn: 3.0–5.0%, Zr: 2.5–6.0%, Mo: 2.0–4.0%, Si: 0.05–0.80%, C: 0.001–0.200%, O: 0.05–0.20%, one of Nb and Ta: 0.3–2.0% and the balance of Ti and inevitable impurities.

In some embodiments of the titanium alloy having good heat resistance according to the present invention it is preferable to limit the content of oxygen to be 0.08–0.13%; the contents of the impurities, Fe, Ni and Cr, to be each up to 0.10%; or the content of Mo+Nb+Ta to be up to 5.0%.

The above method of producing titanium alloy parts having good heat resistance according to the present invention comprises, more specifically, subjecting the titanium alloy having any one of the above described alloy compositions, in a processing step thereof such as billeting, to the following treatment steps:

(1) a heat treatment step in β-region, or at a temperature of β-transformation point or higher, preferably, in a range of β-transformation point+(10–80)° C.;

(2) a rapid cooling step after the heat treatment in β-region at a cooling rate higher than that of air-cooling to a temperature of 700° C. or lower;

(3) a slow cooling step from a temperature of 700° C. or lower at a cooling rate of air cooling or lower;

(4) a hot processing step in α+β region carried out at a temperature of β-transformation point or lower, preferably, in a range of β-transformation point–(30–150)° C., at a forging ratio of 3 or higher to form a part;

(5) a solid solution treatment at a temperature of β-transformation point±30° C.; and (6) an aging treatment at a temperature of 570–650° C.

Another embodiment of the method of producing titanium alloy parts having good heat resistance according to the present invention comprises subjecting the titanium alloy having any one of the above described alloy compositions, in a processing step thereof such as billeting, to the sequence of the following steps:

(1) a heat treatment step in β-region, or at a temperature of β-transformation point or higher, preferably, in a range of β-transformation point+(10–80)° C.;

(2) a quenching step after the heat treatment in β-region by water quenching;

(3) an annealing step to remove distortion in the material;

(4) a hot processing step in α+β region carried out at a temperature of β-transformation point or lower, preferably, in a range of β-transformation point–(30–150)° C., at a forging ratio of 3 or higher to form a part;

(5) a solid solution treatment at a temperature of β-transformation point±30° C.; and (6) an aging treatment at a temperature of 570–650° C.

The following explains the reasons for limiting the alloy composition and the treating conditions.

Al: 5.0–7.0%

Main role of aluminum in this alloy is to strengthen α-phase, and addition of aluminum is effective in improving high temperature strength. To realize this effect addition of 5.0% or more of aluminum is necessary, while too much addition causes formation of an intermetallic compound, $Ti_3Al$, which lowers normal temperature ductility, and thus, addition amount should be limited to up to 7.0%.

Sn: 3.0–5.0%

Tin strengthens both α-phase and β-phase, and therefore, is useful for increasing strength by strengthening both the α- and β-phases under suitable balance therebetween. This effect can be obtained by addition of 3.0% or more. On the other hand, too much addition promotes formation of intermetallic compounds (such as $Ti_3Al$), which results in decreased normal temperature ductility. The upper limit, 5.0%, was thus given.

zr: 2.5–6.0%

Zirconium is also effective in strengthening both the α- and β-phases and therefore, useful for increasing strength by strengthening both the α- and β-phases under suitable balance therebetween. This effect can be obtained by addition of 2.5% or more. On the other hand, too much addition promotes formation of intermetallic compounds (such as $Ti_3Al$), which results in decreased normal temperature ductility. The upper limit, 6.0%, was thus given.

Mo: 2.0–4.0%

Molybdenum strengthens mainly β-phase and is useful for improving effect of heat treating. Addition in an amount of 2.0% or more is required. A larger amount causes decrease in creep strength, and therefore, the amount of addition should be at highest 4.0%.

Si: 0.05–0.80%

Silicon forms silicides, which strengthen grain boundaries to increase strength of the material. The lower limit, 0.05%, is determined as the limit at which the effect is appreciable. Addition of silicon in a large amount will damage operability in producing, and thus, the upper limit, 0.80% was set.

C: 0.001–0.200%

Carbon forms carbides, which also strengthen grain boundaries to increase strength of the material, and further, facilitates quantity control of cubic α-phase just under β-domain. The lower limit, 0.001%, is determined as the limit at which the effect is appreciable. Addition of carbon in a large amount will also damage operability in producing, and thus, the upper limit, 0.200% was set.

Nb+Ta: 0.3–2.0%

Niobium and tantalum strengthen mainly β-phase (the effect is, however, somewhat weaker than that of molybdenum), and therefore, it is useful to add one or two of these elements in an amount (in case of two, in total) of 0.3% or more. A higher amount does not give proportional effect, while increases specific gravity of the alloy. The upper limit, 2.0% in total, was thus determined.

Mo+Nb+Ta: up to 5.0%

As described above, molybdenum, niobium and tantalum are the elements which strengthen mainly β-phase and give improved strength to the alloy. Addition of a large amount will increase specific gravity of the alloy, and therefore, these elements are to be added, when necessary, in total amount up to 5.0%.

O: 0.05–0.20%

Content of oxygen in titanium alloys is generally controlled. However, oxygen is, like aluminum, effective for increasing high temperature strength by strengthening mainly α-phase. In order to obtain such effect oxygen is added to the alloy in an amount of 0.05% or more, preferably, 0.08% or more. Too high an amount tends to decrease ductility and toughness of the material, and thus, the upper limit is set to be 0.20%, preferably, 0.13%.

Fe, Ni, Cr: each up to 0.10%

Among the impurities contents of iron, nickel and chromium are controlled to improve both high temperature creep strength and heat resistance. From this point of view it is preferable to control contents of these impurities each up to 0.10%.

Heat Treatment in β-region

Heat treatment in β-region carried out at a temperature of β-transformation point or higher, preferably, in a range of β-transformation point+(10–80)° C. is conventionally practiced in production of titanium alloy billets of α+β type. This treatment is also carried out in the method of this invention.

Rapid Cooling-Slow Cooling and Water Quenching-Annealing In production of titanium alloy billets of α+β type heat treatment in β-region is usually practiced. In conventional treatment cooling has been done by water quenching. Therefore, remaining stress after this operation is so significant that, in some occasion, crack happens after the water quenching treatment.

In order to solve this problem the first method of this invention employs combination of rapid cooling and slow cooling consisting of cooling after heat treatment in the β-region at a cooling rate higher than that of air cooling to a temperature of 700° C. or lower and cooling thereafter at a cooling rate of air cooling or lower. In other words, the first method aims at decreasing remaining stress and avoiding crack of the material after cooling by rapid cooling during the temperature range down to 700° C. in which coarse α-grains tends to occur and then, slowly cooling.

On the other hand, the second method of this invention employs combination of water cooling and annealing consisting of water cooling after heat treatment in β-region and thereafter, strain-relieving annealing. The second method choose the way to decrease remaining stress by conducting strain-relieving annealing after water cooling which causes much remaining stress.

Hot Processing in α+β region

The heat treatment in α+β region is essential to obtain cubic α-phase. If the processing (such as forging) temperature is too low, productivity decreases and further, crack may occur at processing, and therefore, processing is preferably carried out at a temperature of, at lowest, β-transformation temperature −150° C.

On the other hand, if the processing temperature is too high, material may be locally overheated because of internal heat generation due to processing resulting in formation of overheated structure. The processing temperature is, therefore, up to β-transformation temperature, preferably, β-transformation temperature −30° C.

In the hot processing in α+β region forging ratio should be chosen to 3 or higher so as to sufficiently form cubic α-phase.

Solid Solution Treatment

In order that the properties of the Ti-alloy, the tensile strength, the creep strength and the fatigue strength, may be in good balance, it is effective to carry out solid solution treatment at a temperature around the β-transformation point, preferably, in the range of β-transformation point±30° C.

The solid solution treatment is for controlling the quantity of cubic α-phase. In case where the creep strength is important, it is advisable to carry out the heat treatment in the β-region, while, in case where the fatigue strength is important, the heat treatment in the α+β region.

Aging Treatment

After solid solution treatment, it is advisable to subject the material to aging treatment for the purpose of balancing the strength and the ductility, which is carried out preferably at a temperature ranging from 570° C. to 650° C.

By choosing the above described alloy composition of the titanium alloy and by carrying out the above treatment during the processing such as billeting thereof it is possible to obtain improved titanium alloys, which enjoy increased high temperature strength in addition to the good tensile strength, creep strength and fatigue strength. The invention thus enables further improvement in the heat resistance of titanium alloys which are inherently of good lightness and corrosion resistance. In preferred embodiments where contents of iron, nickel and chromium of the impurities are limited to specific values, creep strength of the alloy is much improved and the heat resistance is further increased.

The alloy can be used as a heat resistant material at an elevated service temperature.

EXAMPLES

Titanium alloys of the alloy compositions A-I and L-N shown in Table 1 were subjected, in the billeting step, to the heat treatment in β-region followed by rapid cooling and slow cooling or water quenching and annealing treatment. The conditions of the treatment are shown in the column of "β-region annealing conditions" in Table 2.

After the annealing in the β-region, samples of the titanium alloys were subjected to hot processing under the conditions shown in the column of "hot processing conditions" in Table 2.

The samples of the titanium alloys were further subjected to solution treatment under the conditions shown in the column of "solution treatment condition" of Table 2, and thereafter, to aging treatment under the conditions shown in the column of "aging condition" of Table 2.

The treated titanium alloy samples were then subjected to tests to determine 0.2% yield strength at 600° C., tensile elongation at room temperature and 600° C., creep. elongation at 540° C. and fatigue strength at 450° C. The results shown in Table 3 were obtained.

As understood from the data in Table 3 the titanium alloy of this invention exhibits excellent strength and ductility, good high temperature creep strength and high temperature fatigue strength, and can be used at a higher service temperature. The titanium alloy thus enjoys, in addition to the lightness inherent to the titanium alloys, improved heat resistance.

TABLE 1

| | Balance: Ti | | | | | | | | | | | |
|---|---|---|---|---|---|---|---|---|---|---|---|---|
| | Al | Sn | Zr | Mo | Si | C | Nb | Ta | O | Fe | Ni | Cr |
| Invention | | | | | | | | | | | | |
| A | 5.8 | 4.1 | 3.6 | 3.1 | 0.35 | 0.06 | — | — | 0.08 | 0.15 | 0.12 | 0.11 |
| B | 5.3 | 4.7 | 4.3 | 8.1 | 0.73 | 0.08 | — | — | 0.06 | 0.14 | 0.11 | 0.10 |
| C | 6.7 | 3.3 | 2.8 | 2.3 | 0.11 | 0.10 | — | — | 0.05 | 0.15 | 0.12 | 0.11 |
| D | 5.8 | 4.1 | 3.3 | 2.5 | 0.30 | 0.08 | 0.7 | — | 0.09 | 0.13 | 0.11 | 0.10 |
| E | 5.6 | 3.8 | 3.7 | 2.8 | 0.50 | 0.04 | — | 1.1 | 0.06 | 0.14 | 0.01 | 0.01 |
| F | 5.9 | 4.3 | 3.6 | 2.6 | 0.40 | 0.07 | 0.8 | 0.5 | 0.13 | 0.04 | 0.01 | 0.01 |
| G | 5.8 | 4.3 | 3.8 | 2.9 | 0.36 | 0.07 | — | — | 0.09 | 0.03 | 0.01 | 0.01 |
| H | 5.8 | 4.4 | 3.9 | 2.8 | 0.31 | 0.03 | 0.8 | — | 0.08 | 0.03 | 0.01 | 0.01 |
| I | 5.1 | 4.7 | 5.9 | 2.7 | 0.34 | 0.04 | 0.8 | — | 0.06 | 0.03 | 0.01 | 0.01 |
| Control Example | | | | | | | | | | | | |
| L | 5.8 | 4.0 | 3.6 | 0.5 | 0.35 | 0.06 | 0.7 | — | 0.13 | 0.15 | 0.12 | 0.11 |
| M | 4.4 | 4.0 | 3.5 | 0.5 | 0.30 | 0.06 | 0.7 | — | 0.13 | 0.14 | 0.11 | 0.12 |
| N | 5.8 | 4.1 | 3.3 | 2.5 | 0.30 | 0.08 | 0.7 | — | 0.30 | 0.13 | 0.12 | 0.11 |

TABLE 2

| No. | Alloy | β-Transformation Point | β-Annealing | Hot Processing | Solid Solution | Aging |
|---|---|---|---|---|---|---|
| Invention | | | | | | |
| 1 | A | 1000° C. | 1030° C.-AC | 950° C.-4S | 980° C.-AC | 600° C.-AC |
| 2 | A | 1000° C. | 1030° C.-AC | 950° C.-4S | 1030° C.-AC | 600° C.-AC |
| 3 | A | 1000° C. | 1030° C.-WC/LA | 950° C.-4S | 980° C.-AC | 600° C.-AC |
| 4 | B | 990° C. | 1070° C.-AC | 900° C.-3S | 980° C.-AC | 650° C. |
| 5 | C | 1040° C. | 1100° C.-AC | 1000° C.-5S | 1030° C.-AC | 570° C. |
| 6 | D | 1018° C. | 1050° C.-AC | 950° C.-5S | 995° C.-AC | 635° C. |
| 7 | D | 1018° C. | 1050° C.-AC | 950° C.-5S | 1030° C.-AC | 635° C. |
| 8 | D | 1018° C. | 1040° C.-WC/LA | 960° C.-4S | 995° C.-AC | 635° C. |
| 9 | D | 1018° C. | 1200° C.-AC | 1050° C.-2.5S | 1005° C.-AC | 635° C. |
| 10 | E | 980° C. | 1030° C. WC-LA | 850° C.-3S | 965° C. AC | 635° C. |
| 11 | F | 1020° C. | 1100° C. AC | 900° C.-4S | 990° C. AC | 620° C. |
| 12 | G | 1010° C. | 1050° C. AC | 970° C.-4S | 985° C. AC | 640° C. |
| 13 | G | 1010° C. | 1050° C. WC-LA | 950° C.-4S | 990° C. AC | 640° C. |
| 14 | G | 1010° C. | 1050° C. WC-LA | 950° C.-4S | 1030° C. AC | 640° C. |
| 15 | H | 990° C. | 1040° C. WC-LA | 920° C.-6S | 1030° C. AC | 630° C. |
| 16 | I | 985° C. | 1000° C. AC | 940° C.-3S | 960° C. AC | 620° C. |
| Control Example | | | | | | |
| 17 | L | 1015° C. | 1040° C. WC | 960° C.-4S | 990° C. AC | 635° C. |
| 18 | M | 1015° C. | 1040° C. WC | 950° C. 4S | 1150° C. AC | 635° C. |
| 19 | N | 1070° C. | 1100° C. WC | 1040° C. 4S | 1080° C. AC | 650° C. |

AC: air cooling,
WC: water cooling,
LA: strain relieving annealing.
The figure before "S" is forging ratio.

TABLE 3

| No. | Alloy | 0.2%-yield strength at Room Temp. (kgf/mm$^2$) | Elongation at Room Temp. (%) | 0.2%-yield strength at 600° C. (kgf/mm$^2$) | Elongation at 600° C. (%) | Creep Elongation at 540° C. 250 MPa 100 hrs (%) | Breaking under LCF 0.1% distorsion at 450° C. (cycle) |
|---|---|---|---|---|---|---|---|
| Invention | | | | | | | |
| 1 | A | 110 | 15.3 | 67 | 20.7 | 0.18 | 13200 |
| 2 | A | 112 | 6.7 | 69 | 18.4 | 0.13 | 9460 |
| 3 | A | 114 | 16.2 | 69 | 20.8 | 0.17 | 13800 |
| 4 | B | 125 | 18.0 | 77 | 25.4 | 0.20 | 9670 |
| 5 | C | 104 | 13.0 | 68 | 19.4 | 0.15 | 13500 |
| 6 | D | 108 | 13.6 | 63 | 23.1 | 0.17 | 16800 |
| 7 | D | 109 | 5.9 | 63 | 19.0 | 0.14 | 8300 |
| 8 | D | 110 | 12.8 | 62 | 21.3 | 0.18 | 14600 |
| 9 | D | 107 | 6.7 | 60 | 19.2 | 0.20 | 8500 |
| 10 | E | 110 | 14.3 | 67 | 22.4 | 0.18 | 17300 |
| 11 | F | 127 | 21.1 | 74 | 24.8 | 0.19 | 12300 |
| 12 | G | 109 | 13.7 | 63 | 21.8 | 0.15 | 15900 |
| 13 | G | 108 | 14.1 | 60 | 23.7 | 0.16 | 16700 |
| 14 | G | 111 | 7.7 | 64 | 16.6 | 0.12 | 10100 |
| 15 | H | 105 | 16.0 | 60 | 21.7 | 0.18 | 9300 |
| 16 | I | 105 | 16.0 | 60 | 21.7 | 0.18 | 9300 |
| Control Examples | | | | | | | |
| 17 | L | 100 | 12.7 | 55 | 20.0 | 0.16 | 8900 |
| 18 | M | 81 | 4.2 | 39 | 37.0 | 0.35 | 3400 |
| 19 | N | 85 | 0.2 | 61 | 13.2 | 0.15 | 11200 |

We claim:

1. A method of producing titanium alloy parts having good heat resistance, comprising subjecting a titanium alloy composition consisting essentially of, by weight %, Al: 5.0–7.0%, Sn: 3.0–5.0%, Zr: 2.5–6.0%, Mo: 2.0–4.0%, Si: 0.05–0.80%, C: 0.001–0.200%, O: 0.05–0.20%, and the balance of Ti and inevitable impurities to the following sequential treatment steps:

(1) a heat treatment step in β-region;

(2) a rapid cooling step after the heat treatment in step (1) at a cooling rate higher than that of air-cooling to a temperature of 700° C. or lower;

(3) a slow cooling step from a temperature of 700° C. or lower at a cooling rate of air cooling or lower;

(4) a hot processing step in α+β region carried out at a temperature of β-transformation point or lower at a forging ratio of 3 or higher;

(5) a solid solution treatment at a temperature of β-transformation point±30° C; and (6) an aging treatment at a temperature of 570–650° C.

2. A method of producing titanium alloy parts having good heat resistance according to claim 1, wherein the titanium alloy further consist essentially of at least one of Nb and Ta in a combined total of 0.3–2.0%.

3. A method of producing titanium alloy parts having good heat resistance, comprising subjecting a titanium alloy composition consisting essentially of, by weight %, Al: 5.0–7.0%, Sn: 3.0–5.0%, Zr: 2.5–6.0%, Mo: 2.0–4.0%, Si: 0.05–0.80%, C: 0.001–0.200%, O: 0.05–0.20%, and the balance of Ti and inevitable impurities to the following sequential treatment steps:

(1) a heat treatment step in β-region;

(2) a quenching step after the heat treatment in step (1) by water quenching;

(3) an annealing step to remove distortion in the material;

(4) a hot processing step in α+β region carried out at a temperature of β-transformation point or lower at a forging ratio of 3 or higher;

(5) a solid solution treatment at a temperature of β-transformation point±30° C.; and (6) an aging treatment at a temperature of 570–650° C.

4. A method of producing titanium alloy parts having good heat resistance according to claim 3, wherein the titanium alloy further consist essentially of at least one of Nb and Ta in a combined total of 0.3–2.0%.

5. A method of producing titanium alloy parts having good heat resistance according to claim 1, wherein the heat treatment in step (1) is conducted in a range of β-transformation point+(10–80)° C.

6. A method of producing titanium alloy parts having good heat resistance according to claim 1, wherein the hot processing in step (4) is conducted in a range of β-transformation point−(30–150)° C.

7. A method of producing titanium alloy parts having good heat resistance according to claim 3, wherein the heat treatment in step (1) is conducted in a range of β-transformation point+(10–80)° C.

8. A method of producing titanium alloy parts having good heat resistance according to claim 3, wherein the hot processing in step (4) is conducted in a range of β-transformation point−(30–150)° C.

* * * * *